United States Patent [19]

Johnson et al.

[11] 4,188,895

[45] Feb. 19, 1980

[54] NEEDLE BIGHT CONTROL MECHANISM

[75] Inventors: Ralph E. Johnson, Convent Station, N.J.; John A. Urciola, Sarasota, Fla.

[73] Assignee: The Singer Company, New York, N.Y.

[21] Appl. No.: 971,963

[22] Filed: Dec. 21, 1978

[51] Int. Cl.[2] ..... D05B 3/02

[52] U.S. Cl. ..... 112/158 D

[58] Field of Search ..... 112/158 R, 158 A, 158 D

[56] References Cited

U.S. PATENT DOCUMENTS

| | | | |
|---|---|---|---|
| 3,006,297 | 10/1961 | Urscheler | 112/158 A |
| 3,012,527 | 12/1961 | Sternberg | 112/158 A |
| 3,041,988 | 7/1962 | Fujita . | |
| 3,066,623 | 12/1962 | Reeber et al. . | |
| 3,208,417 | 9/1965 | Eguchi et al. | 112/158 D |
| 3,229,654 | 1/1966 | Eguchi . | |
| 3,247,817 | 4/1966 | Eguchi . | |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A sewing machine is provided with a unique needle bight control module including a rotatable cam stack, a cam follower for each of the cams of the cam stack, and a drum with interposers thereon selectively disposable against the cam followers for causing needle bight controlling linkage means to be moved during rotation of the cam stack according to the design of the cam which is associated with the cam follower selectively engaged by the interposer. Indexing means embraces and holds the cams, interposers and cam followers in alignment.

9 Claims, 5 Drawing Figures

NEEDLE BIGHT CONTROL MECHANISM

BACKGROUND OF THE INVENTION

1. Field of the Invention

The invention relates to mechanism for controlling needle bight in a sewing machine.

2. Description of the Prior Art

Needle bight controlling mechanisms including cams which can selectively be brought into play to cause a needle to be moved in zig-zag fashion according to the design of the cams are well known. Such mechanisms, however, have generally been unduly complex and have failed to provide trouble free operation over long periods of time. Furthermore such mechanisms have been difficult to assemble, and in particular could not be easily assembled with relatively few parts into a module for subsequent insertion in the machine. It is a prime object of the present invention to provide an improved needle bight control mechanism which requires few parts, which can be readily and economically manufactured as a sub-assembly apart from the machine and which will operate reliably over long periods of time.

SUMMARY OF THE INVENTION

In accordance with the invention there is provided a needle bight control mechanism including a rotable cam stack, a cam follower for each of the cams of the cam stack mounted for pivotal and translational movement, a pivoted bracket which is part of needle bight actuating linkage means and which is subject to actuation of the cam followers, a drum having an interposer thereon for each cam follower, means for turning the drum to selectively dispose a follower to interact with its associated cam and actuate the pivoted bracket, and indexing means operably associated with the interposer carrying drum, the indexing means being adapted to embrace and hold the cams of the cam stack and cam followers in alignment. The entire mechanism is mounted in a supporting structure which is securable with just a few screws in the machine.

DESCRIPTION OF THE PREFERRED EMBODIMENT

Figure 1:
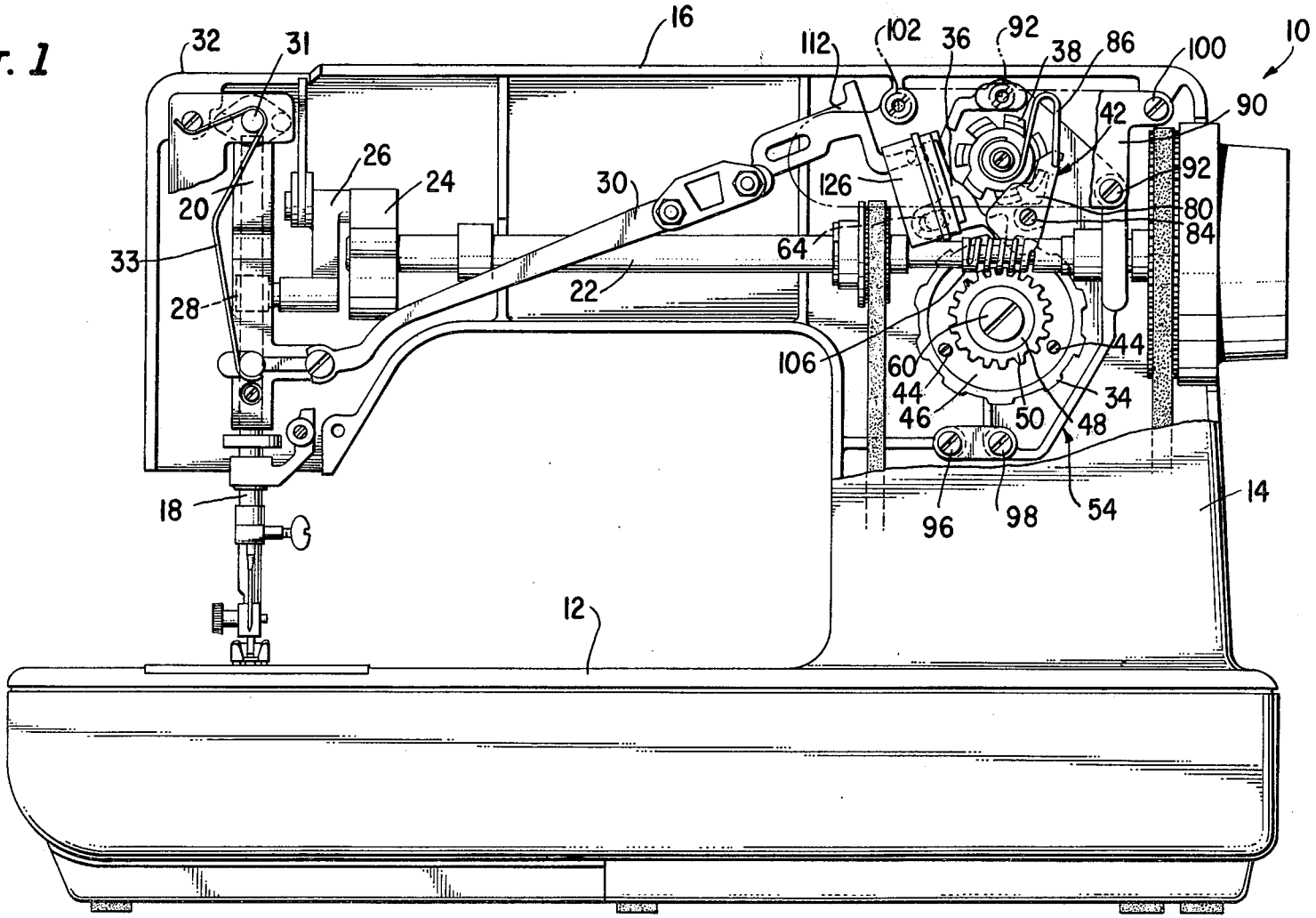
FIG. 1 is a front elevational view of a sewing machine from which a portion of the front cover has been broken away to show the needle bight control mechanism of the invention.

Referring to FIG. 1 of the drawings, a sewing machine 10 is shown as including a bed 12, a standard 14 rising from the bed and a bracket arm 16 overhanging the bed. A needle bar 18 is supported in a gate 20 for endwise reciprocation by an arm shaft 22 acting through a crank 24, drive link 26 and needle bar attached collar 28. As shown the gate 20 is mounted at its upper end for pivotal motion on a shaft 31 located in frame 32 such that zig-zag motion is imparted to a needle 33 when actuating forces are exerted on the gate by a needle bight control link 30 and return spring 32.

Figure 2:
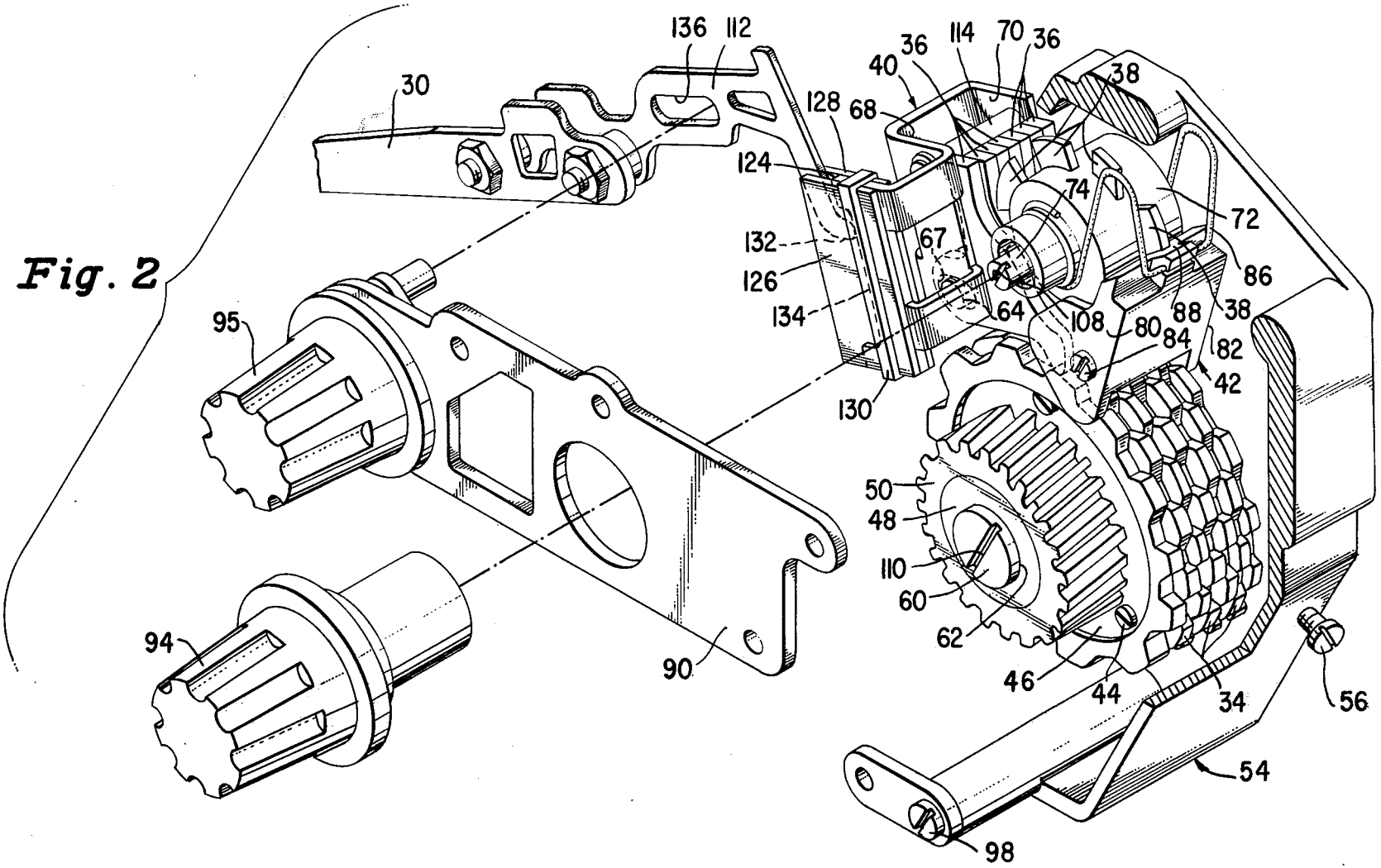
FIG. 2 is a perspective partially exploded view showing the needle bight control mechanism of the invention.
Figure 3:
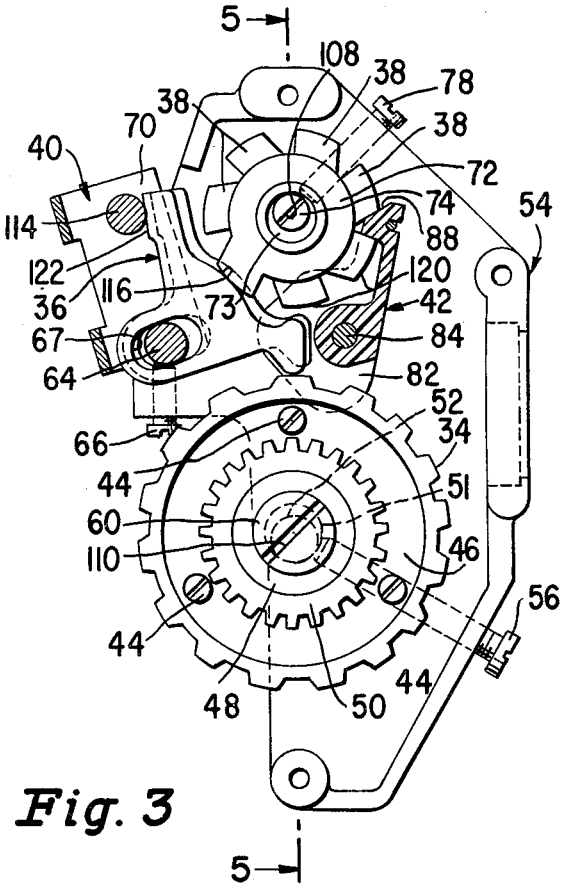
FIG. 3 is a front elevational view, partially in section, of the needle bight control mechanism showing a cam follower on a raised surface of an actuating cam.
Figure 4:
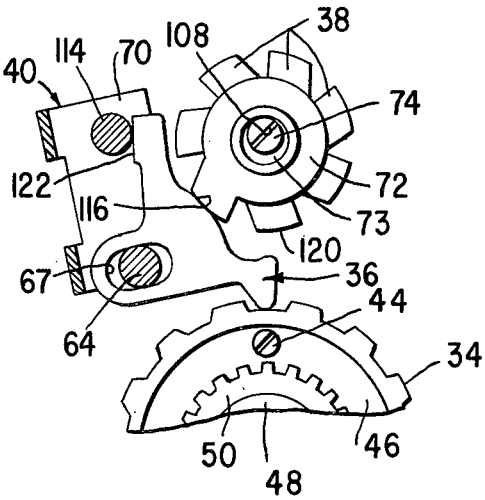
FIG. 4 is a fragmentary front elevational view of the needle bight control mechanism showing the cam follower in a trough of the actuating cam.
Figure 5:
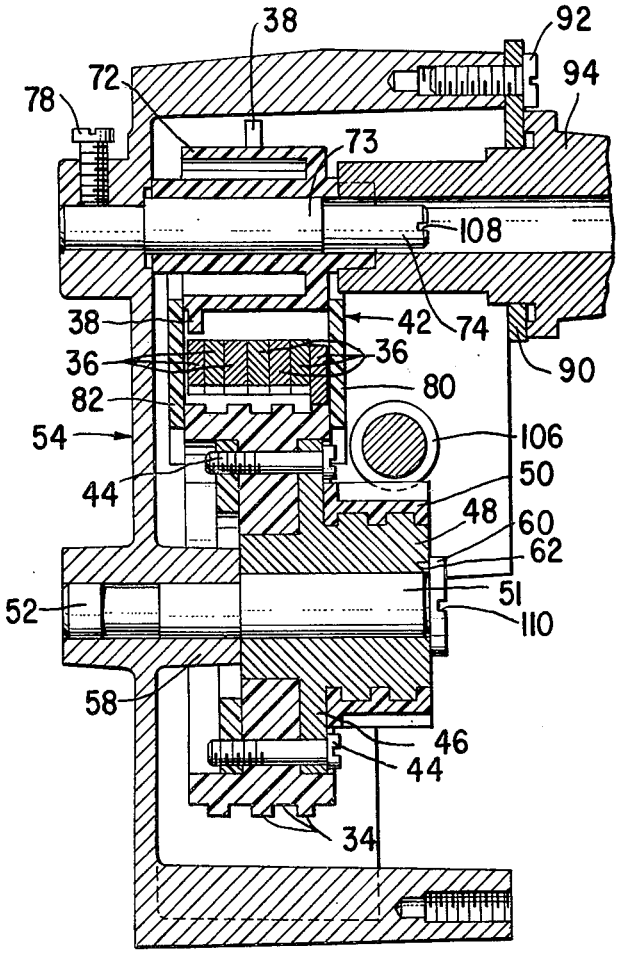
FIG. 5 is a sectional view taken on plane of the line 5—5 of FIG. 3.

Mechanism is provided in accordance with the invention for controlling needle bight, that is the amplitude of needle zig-zag movements. Such mechanism, which is best shown in FIGS. 2, 3 and 4, includes a plurality of side-by-side rotatable cams 34, a follower 36 for each of the cams, an interposer 38 for each of the cam followers, a bracket 40 wherein the cam followers are assembled, and an indexing pawl 42 which embraces the cams, the cam followers and interposers.

The cams 34 are securedly screws 44 to the flange 46 of a sleeve 48 having a plastic gear 50 molded into a fixed position thereon. The sleeve is rotatably mounted on an eccentric portion 51 of a shaft 52 which is affixed in frame 54 by a screw 56; and when gear 50 is caused to rotate, rotation is imparted to sleeve 48 and the cams 34. Axial movement of the cams 34, sleeve 48 and gear 50 is restrained by a boss 58 of the frame 54 located opposite one end of sleeve 48, and by a screw 60 which is integral with shaft 52 and has a shoulder 62 opposite the other end of the sleeve.

The cam followers 36 are mounted on a pin 64 which is affixed in frame 54 by a screw 66. Pin 64 extends through a slot 67 in each of the cam followers and the cam followers can both pivot and slide on the pin. The pin also extends through bracket 40 and the bracket may pivot on the pin. As shown, the cam followers 36 are located on pin 64 between sides 68 and 70 of bracket 40. As noted hereinbefore, there is an interposer 38 for each cam follower 36. Such interposers are located on a drum 72 which is turnable on an eccentric portion 73 of a shaft 74 that is secured to frame 54 by screw 78.

Pawl 42 includes side walls 80 and 82 which embrace the axially fixed cams, the cam followers and the interposer drum to maintain each of the cam followers in alignment with a particular cam and maintain the interposer drum 72 in a position on shaft 74 wherein each of the interposers is aligned with a particular cam follower. The pawl 42 is pivotally mounted on a pin 84 affixed in the frame 54 and is biased about the pin by a spring 86 against the interposer drum. The pawl is formed at 88 to engage adjacent interposers 38 and define indexed positions for the drum wherein a selected interposer is disposed opposite its associated cam follower for engagement by the cam follower.

The entire needle bight control mechanism including a plate 90 secured by screw 92 to frame 54, a control knob 94 for turninng interposer drum 72, and a control knob 95 for use as hereinafter described can be readily assemble into a subassembly apart from the sewing machine casing and thereafter secured in place as with screws 96, 98, 100, 102 and a bracket 104 extending between the screws 100 and 102. Before the subassembly is affixed in the machine various adjustments can be made in the needle bight control mechanism as required for proper operation. Such adjustments include an adjustment in the position of the interposer drum 72 relative to the cam follower and an adjustment in the position of gear 50 as required for proper engagement with a worm 106 on the arm shaft 22 of the machine. The adjustment in the position of the interposer drum is accomplished by turning shaft 72 as with a screw driver in slot 108 to selectively position eccentric portion 73 of the shaft before the shaft is finally affixed in frame 64 with screw 78. The adjustment in the position by gear 50 is accomplished by turning shaft 52 with a screwdriver in slot 110 of screw 60 to selectively position eccentric portion 112 of the shaft 52 before such shaft is finally affixed in frame 54 with screw 56.

Bracket 40 of the needle bight control mechanism connects through a link 112 and needle bight control link 30 with needle bar gate 20. An operator selects an interposer 38 for engagement by a particular cam follower 36 with control knob 94, and spring 33 acting through links 30 and 112 urges bracket 40 about pin 64 to thereby cause a fixed pin 114 in the bracket to urge the cam followers about the pin 64 to positions wherein the interposer selected with the control knob 94 is engaged at cam surface 116 by the aligned cam follower 36 and one end of such cam follower is in contact with its associated cam 34. Gear 50 is rotated continuously by engaging worm 118 on arm shaft 22 during operation of the machine and the cams 34 rotate with the gear. The cam follower in engagement with the selected interposer is actuated by the high spots on the associated rotating cam and pivots about pin 64 causing surface 116 thereon to act against surface 120 of the selected interposer, and cam follower 122 to act against pin 114 in bracket 40. The bracket is pivoted about pin 64 by the cam follower and motion is imparted to the needle bar gate 20 through links 112 and 30 causing the needle bar gate to move to the left as viewed in FIG. 1. When the cam follower moves off a high spot on the engaged cam the gate 20 is moved to the right by the action of spring 33 which also acts through links 30 and 112, and bracket 40 to keep the cam follower in contact with its associated cam. All of the cam followers 36 other than the cam follower opposite the selected interposer float on pin 64 during rotation of cams 34 and exert no effect on the motion of bracket 40 and the needle bar gate 20.

As shown link 112 terminates in a slot 124 formed between side pieces 126 and 128 which are affixed to bracket 40 with a strap 130. The end 132 of link 112 in slot 124 rides on an edge 134 of the bracket. Link end 132 may be positioned along the edge 134 with control knob 95 which is affixed to a pin 135 slidable in a slot 136 is link 112, and in this way the amplitude of the movement of the needle bar gate 20 and thereby the width of the needle bight obtained in response to the interaction of a cam follower and associated cam following the selection of a particular interposer may be predetermined by an operator. The closer link end 132 is located to the top of edge 134 the greater the width of the needle bight obtained, and when link end 132 is at the bottom end of curved edge 134 in line with the axis of pin 64, straight stitches results.

As shown links 30 and 112 are affixed to one another by bolts 138 and 140, and the nuts 142 and 144. The bolts extend through slots in link 112 (not shown) to permit the links 30 and 112 to be slidably adjusted relative to each other at the time the machine is manufactured and a straight stitch location to be thereby established for the needle 33 with link end 132 in line with the axis of pin 64. Edge 134 is formed with a slight curvature which maintains the straight stitch location of the needle as a median postion regardless of the width of needle bight selected by an operator with knob 95.

Although only a particular preferred embodiment of the invention has been shown and described by way of illustration, various modifications will occur to those skilled in the art, and it is, therefore to be understood that it is intended herein to cover all such modifications as fall within the true spirit and scope of the invention.

We claim:

1. Mechanism operable to produce needle bight controlling movements for use in positioning the needle bar gate of a sewing machine including a plurality of rotatable cams, a cam engageable follower for each of the said cams pivotally and translationally movable, a movable member operably connected with the cam followers, a drum having an interposer thereon for each cam follower, means for turning the drum to selectively dispose an interposer opposite its associated cam follower so that such cam follower is caused to interact with its associated cam and the selected interposer during rotation of the cams and to impart movements to said member for controlling the position of the gate, and indexing means for the interposer drum adapted to embrace and hold the cams, the interposers and cam followers in alignment.

2. The combination of claim 1 wherein the indexing means includes a member disposable between adjacent ones of the said interposers on the drum for defining selected drum positions.

3. The combination of claim 1 wherein the member operably connected with the cam followers is pivotally movable.

4. The combination of claim 1 including means mounting said movable member and cam followers for pivotal motion about a common axis.

5. The combination of claim 1 including linkage means operably connecting said movable member with the needle bar gate, and a manual control operably connected with said linkage means for prescribing the amplitude of needle gate movement in response to the operation of said movable member.

6. The combination of claim 1 including a frame adapted for attachment within the sewing machine and means mounting the cams, the interposer drum, the cam followers and said movable member on the frame.

7. The combination of claim 1 including a frame adapted for attachment within the sewing machine and means mounting the cams, the interposer drum, the cam followers, the movable member and said indexing means on the frame.

8. The combination of claim 7 including a gear connected to the cams for rotating the cams.

9. The combination of claim 8 wherein the positions of the interposer drum and said gear are adjustable in the frame.

* * * * *